US005561950A

United States Patent [19]

Collins et al.

[11] Patent Number: 5,561,950

[45] Date of Patent: Oct. 8, 1996

[54] METHOD AND APPARATUS FOR ADJUSTABLE PIER BLOCK

[76] Inventors: Ted R. Collins, P.O. Box 83, Hoquiam, Wash. 98550; Denamarshell L. Deal, 15325 Redmond Way #H-194, Redmond, Wash. 98052

[21] Appl. No.: 219,980

[22] Filed: Mar. 30, 1994

[51] Int. Cl.[6] ..... E02D 27/32; E02D 27/00

[52] U.S. Cl. ..... 52/126.6; 52/126.7; 52/169.9; 52/169.12; 52/299; 52/745.12; 248/354.3

[58] Field of Search ..... 52/126.6, 126.7, 52/126.5, 169.9, 169.12, 299, 292, DIG. 11, 742, 126.3, 126.4, 745.12, 745.09; 248/354.3, 188.4; 403/109; 254/98, 99, 100, 102

[56] References Cited

U.S. PATENT DOCUMENTS

| | | | |
|---|---|---|---|
| 2,535,965 | 12/1950 | Roggensack | 248/354.3 X |
| 3,093,362 | 6/1963 | Schaeffer | 248/354.3 X |
| 3,645,054 | 2/1972 | Olvera | 248/354.3 X |
| 3,831,329 | 8/1974 | Lear | 248/354.3 X |
| 4,229,919 | 10/1980 | Hughes | 52/263 |
| 4,404,780 | 9/1983 | Josephson | 52/126.7 |
| 4,546,581 | 10/1985 | Gustafson | 52/169.9 |
| 4,632,356 | 12/1986 | Munz | 248/188.4 X |

FOREIGN PATENT DOCUMENTS

| | | | |
|---|---|---|---|
| 1266963 | 3/1972 | United Kingdom | 52/126.6 |

*Primary Examiner*—Kien T. Nguyen
*Attorney, Agent, or Firm*—Paul L. Griffiths

[57] ABSTRACT

An adjustable pier block for leveling a deck or porch is disclosed. A footing block or base is cast of concrete and a threaded rod is placed vertically therein. A coupling having internal threads and a plurality of flats on an outer surface thereof is threaded onto the rod. A U-shaped saddle member, sized to receive a joist or beam, has a connector attached to a bottom outer surface thereof. The connector is sized and shaped to slidingly receive a free end of the coupling against a load bearing surface or the bottom side of the saddle. A washer or disk, of made from a friction reducing material, can be inserted between the coupling and the load bearing surface for ease of operation. The coupling can be turned, by use of a wrench cooperating with the flats, in order to raise or lower the beam or joist for leveling a deck during construction thereof and at a later date after settling has occurred.

11 Claims, 2 Drawing Sheets

METHOD AND APPARATUS FOR ADJUSTABLE PIER BLOCK

TECHNICAL FIELD

The present invention relates to foundation structures, and more particularly, to an adjustable pier block for leveling structural members such as beams or joists of patio decks.

BACKGROUND ART

It is well known in the construction of outdoor (patio) decks and porches to use a foundation unit commonly known as a pier block. Another commonly used method of supporting a deck is to use a post, either metal or wood, placed directly into freshly poured concrete and is thereby firmly held in place when the concrete hardens. Due to the difficulty of getting all of the pier blocks or footing members in a level plane, a support beam held by such members is equally difficult to level. Typically, once the beams are placed on the supports a wedge is used to adjust the height, and therefore level the structural beams. It is not uncommon for a pier block or post to have a saddle member attached to the top thereof which fits around the structural beam and is attached by either nailing or screwing the saddle and beam together. Even when the pieces are not securely fastened, it is still difficult to relevel the deck after a period of time, when one or more of the pier blocks or footings has settled. Some of the prior art components and techniques are discussed hereinafter. The present invention provides a pier block that is adjustable during construction of a deck or the like, for leveling support beams, and is capable of additional adjustment after any settling occurs.

Hughes, U.S. Pat. No. 4,229,919, issued Oct. 28, 1980, discloses a kit of components for interconnecting structural members. The first structural member or foundation support shown and described includes a hole filled with concrete wherein a pipe inserted therein to a depth equal in height to a string tied to stakes for aid in leveling a plurality of pipes. It is described that the pipes may be cut-off after the concrete has hardened, or shimmed up as much as two inches by using short pieces of pipe or washers. A ground saddle having a short piece of tube extending therefrom is then placed over the top of each pipe. Then the structural members, such as beams, are placed in the ground saddles, which are adjustable for varying widths of joists or beams. Once the deck is completed it is impractical or impossible to adjust the height of the pipes due to the weight of the decking on each saddle.

Josephson, U.S. Pat. No. 4,404,780 issued Sep. 20, 1983, discloses a support system for restraining lateral movement of pier mounted buildings. A pier block is shown and described which has an angle bracket for supporting a structural beam. Part of the pier block includes a jack screw which is attached to the angle bracket. The jack screw extends down through an adjusting nut into the pier block. The nut is very thin with only a minimum number of internal threads. The adjusting nut can be turned to either raise or lower the jack screw and the structural beam. The adjusting nut has a bearing surface on the top of the pier block. The jack screw is prevented from turning due to its attachment to the top bracket which is fixedly held to the structural beam. It is the angle bracket and its relationship to the structural beam preventing the structural beam from moving laterally that is the object of this reference.

SUMMARY OF THE INVENTION

The present invention provides a pier block with an apparatus for adjusting the height of a structural member such as a deck beam. The adjustable pier block includes a footing member with a threaded rod fixedly held therein. A coupling having an internal thread for mating with the threaded rod is threaded onto the rod after the footing has been set on the ground or on a foundation. A bracket having a tubular portion attached thereto is then placed over the top end of the coupling. A structural beam can then be placed on top of the bracket. In order to adjust the height of the beam, the coupling can be turned in one direction for raising and in the opposite direction for lowering the beam in order to level the beam. For ease in turning the coupling, it can have a plurality of flats formed on the outer surface thereof such that a wrench or the like can be used.

The footing member is usually constructed of concrete having a square footprint and trapezoidal sides such that the top of the pier block is smaller in surface area than its bottom surface area.

It is preferred that the threaded rod have acme style threads to increase the strength and allow for ease of raising or lowering a structural member such as a beam.

In order to aid in adjusting the pier block, a friction reducing washer or disk can be placed between the top end of the coupling and the bottom side of the bracket.

BRIEF DESCRIPTION OF THE DRAWINGS

In the drawings, like reference numerals and characters refer to like parts throughout the various views and wherein.

BEST MODE FOR CARRYING OUT THE INVENTION

Figure 1:
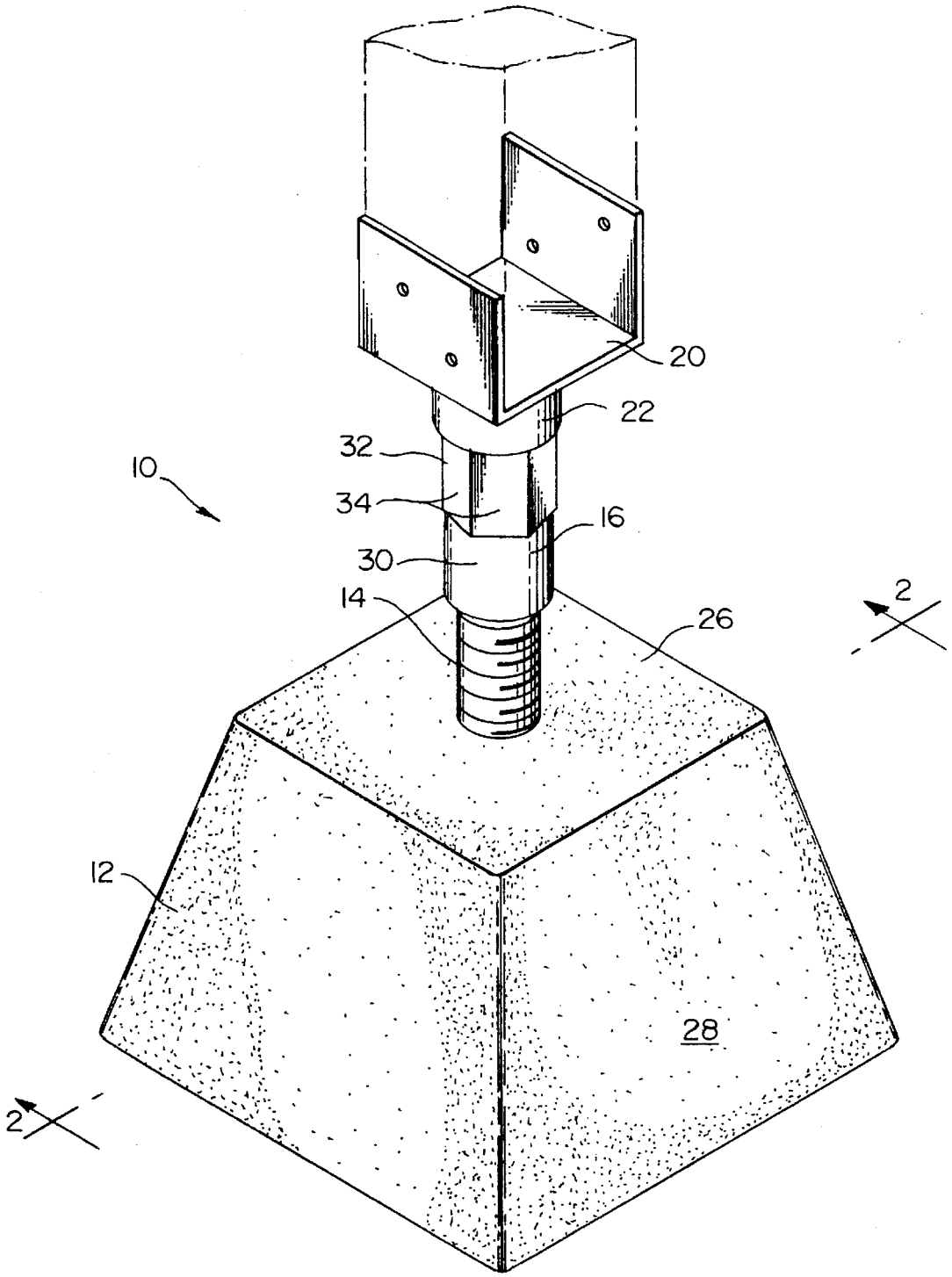
FIG. 1 is a prospective view of the present invention taken from above with a structural post shown in phantom.

Referring now to FIG. 1, an adjustable pier block 10 is shown. Pier block 10 includes a base portion 12 which may act as a footing member or can be placed on top of a concrete footing pad (not shown). A threaded rod 14 is held against rotation and axial movement within base portion 12. A coupling 16 having internal threads 18 that match those of threaded rod 14 is threaded onto rod 14. A bracket 20 is sized to receive standard sizes of wood beams, such as four by ten or the like. Attached to the underside of bracket 20 is a connector 22. Connector 22 is sized to receive slidingly coupling 16.

The best mode for currently constructing the above described components will now be discussed. Base portion 12 is cast from concrete. The casting is generally made such that block 12 has a footprint that is larger in surface area than its top 26. Thus, sides 28 are formed that are trapezoidal in shape. While the concrete is still green, threaded rod 14 is pushed into block 12. In this manner, the concrete oozes between the threads of rod 14 thereby increasing the axial strength of the bond therebetween. It is preferred to have acme threads on rod 14. While it is shown in FIG. 2 that rod 14 is held in position by the entire height of base 12, it is within the scope of the best mode that a shorter length of rod could be encased within base 12.

Figure 2:
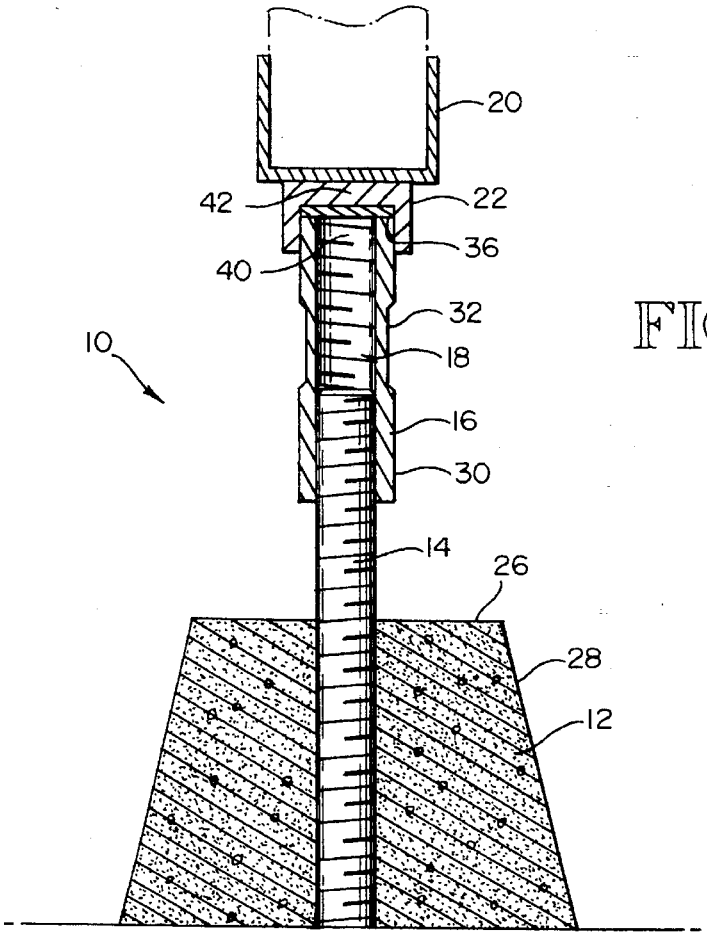
FIG. 2 is a sectional view of an adjustable pier block taken substantially along line 2—2 of FIG. 1.

As shown in FIGS. 1 and 2, coupling 16 is cylindrical in nature having internal threads 18 formed therein. Either tubular stock or rod stock can be used to form this piece. Other methods of construction could be used to form this piece in order to reduce its cost. Coupling 16 includes an outer surface 30 which includes a means 32 for aiding in rotation, such as a plurality of flats 34. Flats 34 are formed on outer surface 30 such that a wrench or the like can engage that portion of coupling 16 for the purpose of turning it. Coupling 16 also includes a bearing surface 36. Bearing surface 36 contacts and supports an engaging means which is either an end wall 42 of connector 22 or bracket 20 as hereinafter described.

Figure 4:
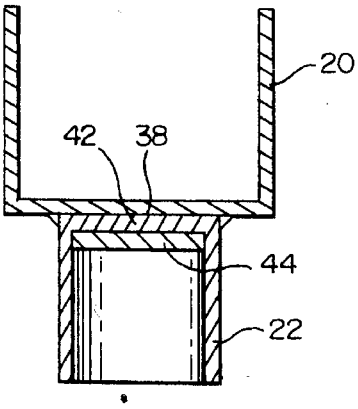
FIG. 4 is a sectional view taken substantially along lines 4—4 in FIG. 3 of the bracket and connector.
Figure 3:
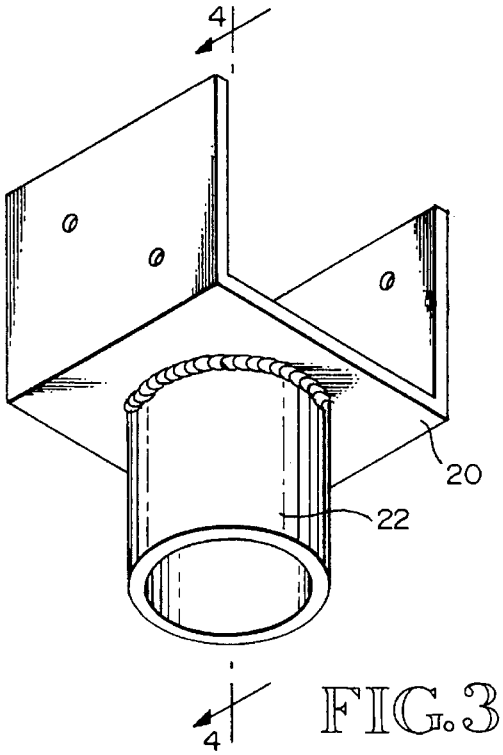
FIG. 3 is a slightly enlarged perspective view of a bracket portion of the pier block showing a connector attached thereto.

Referring now to FIGS. 3 and 4, bracket 20 and connector 22 are described. Bracket 20, made from galvanized sheet metal, is generally available in lumber or hardware stores. Bracket 20 includes a bottom surface 38. Connector 22 is fixedly attached to bottom surface 38 by welding or the like. Connector 22 is formed from bar stock with a cylindrical portion removed from the center using an end cutter. Tubular stock with an end plate, also referred to as end wall 42, welded thereto could also be used or, a tubular stock could be welded directly to bottom surface 38, if bracket 20 has sufficient strength for this purpose. Connector 22 is sized to slidingly receive upper end 40 of coupling 16. End wall 42 of connector 22 provides a bearing surface for carrying the load between itself and bearing surface 36 of coupling 16. In order to reduce friction therebetween, a washer 44 may be fit between end wall 42 and bearing surface 36. Washer 44, which may be in the form of a disk, is preferably made from a friction reducing material such as NYLATRON®.

From the foregoing, further modifications, component arrangements, and modes of utilization of the invention which will be apparent to those skilled in the art to which the invention is addressed. The scope of protection is not to be limited by the details of the embodiments which have been illustrated and described. Rather, the scope of protection is to be determined by the appended claims, interpreted in accordance with the established rules of patent claim interpretation, including the doctrine of equivalence.

I claim:

1. A pier block capable of adjusting the height of a structural member, such as a deck beam, comprising:

a footing member;

a threaded rod, said rod having an end portion anchored within said footing member;

a coupling, said coupling having internal threads mating with said threaded rod, said coupling also having a bearing surface at one end of said coupling;

a connector, said connector having engaging means for engaging said bearing surface, and attachment means for attaching a structural member thereto; and said engaging means includes an end wall of said connector, said end wall forming a base for support of said attachment means, whereby said end wall is load bearing for transfer of load to said bearing surface of said coupling.

2. The pier block of claim 1, wherein an anti-friction disk is placed between said end wall and said bearing surface.

3. A pier block capable of adjusting the height of a structural member, such as a deck beam, comprising:

a footing member;

a threaded rod, said rod having an end portion anchored within said footing member;

a coupling, said coupling having internal threads mating with said threaded rod, said coupling also having a bearing surface at one end of said coupling; and a connector, said connector having engaging means for engaging said bearing surface, and attachment means for attaching a structural member thereto; and said coupling includes a means for aiding in the rotation of said coupling for adjusting the height of said bracket.

4. The pier block of claim 3, wherein said footing member is formed from concrete.

5. The pier block of claim 3, wherein said footing member has a square footprint and trapezoidal shaped sides.

6. The pier block of claim 3, wherein said threaded rod includes acme style threads thereon, and said coupling has mating internal threads.

7. The pier block of claim 3, wherein said means for aiding in rotation includes a plurality of flats formed on an outer surface of said coupling whereby a wrench may be used to engage at least two of said flats for rotating said coupling.

8. The pier block of claim 3, wherein said connector includes a U-shaped saddle bracket for receiving a structural member, said saddle bracket being attached to said connector in a manner preventing it from rotating relative to said structural member when said coupling is rotated.

9. The pier block of claim 3, wherein said rod and said coupling include acme style threads.

10. A method of adjusting the height of a deck beam during and after construction including the steps of:

forming a footing block having a threaded rod extending therefrom, threading a coupling having internal threads onto a free end of said rod, placing a bracket including a connector over a top end of said coupling, said top end and said bracket forming a bearing surface therebetween, and rotating means for rotating said coupling whereby said coupling moves in relation to said rod thereby changing the height of said bracket which in turn adjusts the height of a beam supported by said bracket.

11. The method of claim 10, including the step of placing a disk of anti-friction material between said top end of said coupling and bracket for reducing the friction therebetween and causing the coupling to be easier to rotate.

* * * * *